United States Patent [19]

Spinks, Sr. et al.

[11] 4,065,092

[45] Dec. 27, 1977

[54] QUICK RELEASE SECURITY LATCH DEVICE FOR RADIO ANTENNA BASE

[75] Inventors: Maurice H. Spinks, Sr.; Yvon E. Juge, both of Fort Worth, Tex.

[73] Assignee: SouthCom, Inc., Fort Worth, Tex.

[21] Appl. No.: 675,996

[22] Filed: Apr. 12, 1976

[51] Int. Cl.[2] ..... B65J 1/22

[52] U.S. Cl. ..... 248/503; 24/69 R; 343/713

[58] Field of Search ..... 248/154, 226 R, 226 D, 248/231, 500, 503, 505, 539; 343/713, 715; 24/69 R

[56] References Cited

U.S. PATENT DOCUMENTS

| | | | |
|---|---|---|---|
| 1,177,728 | 4/1916 | Snyder et al. | 248/505 |
| 1,825,117 | 9/1931 | Hudson | 248/231 X |
| 3,022,970 | 2/1962 | Watkins | 248/231 X |
| 3,555,551 | 1/1971 | Gronlund | 248/226 R |

FOREIGN PATENT DOCUMENTS

| | | | |
|---|---|---|---|
| 192,695 | 12/1956 | Austria | 24/69 T |

*Primary Examiner*—William H. Schultz
*Attorney, Agent, or Firm*—H. Mathews Garland

[57] ABSTRACT

A quick release security latch device for a radio antenna base particularly adapted to releasably lock a base for a citizen's band radio antenna on a supporting member such as a trunk lid lip of an automobile and the like. The latch device includes a clamping loop connectible with the antenna base, a tension lever engageable wtih the clamping loop, and a bracket for mounting the tension lever on the supporting structure. The tension lever is movable between a first release position at which the clamping loop is disengageable from the tension lever for release of the antenna base from the supporting structure and a second position at which the clamping loop is tightly held to lock the antenna base on the supporting structure.

2 Claims, 3 Drawing Figures

QUICK RELEASE SECURITY LATCH DEVICE FOR RADIO ANTENNA BASE

This invention relates to latches and more particularly relates to a quick release security type latch device especially adapted for mounting antenna radio bases on a supporting structure.

In recent years citizen's band radios have become extremely popular. Such radio systems are most often used with vehicles such as automobiles, trucks, boats, and the like. The radios require external antennas which, in the case of automobiles, are normally mounted on the trunk lid. Theft of the citizen's band radios and related equipment including the antennas has developed into a major problem. So long as an antenna for such a radio is mounted on an automobile or trunk, it is obvious to a prospective thief that the vehicle is equipped with such a radio system. While a thief can look into the vehicle to determine if it is equipped with a radio, a more quickly noticeable clue is the existence of an antenna which can be observed from some distance away. Of course, it will be recognized that the potential thief is frequently interested in taking both the radio antenna and the citizen's band radio from the car. A further problem involved with such systems is malicious mischief wherein radio antennas are simply bent or broken off vehicles. Thus, a desirable end objective to deter theft of both antennas and radios is means wherein the radio antenna is not observable at all when the vehicle is not occupied. While some devices are available for folding or otherwise secluding such radio antenna, these that are known to exist are relatively expensive, complicated, and occupy substantial space.

It is a principal object of the invention to provide an improved form of security latch device for releasably connecting a radio antenna to supporting structure, particularly on a vehicle.

It is another object of the invention to provide a security latch device for a radio antenna which permits complete removal of the antenna from the supporting structure.

It is another object of the invention to provide a security latch device for a radio antenna base which is simple and inexpensive to manufacture.

It is another object of the invention to provide a security latch device for a radio antenna base which utilizes available antenna base mounting structure.

In accordance with the invention, there is provided a security latch device for a radio antenna base which includes a clamping loop connectible at opposite free ends with the base of a radio antenna and a tension lever assembly having a bracket connectible with the antenna supporting structure for engaging and releasably locking the clamping loop for holding the radio base on the supporting structure.

The foregoing objects and advantages of a security latch device for a radio antenna base embodying the features of the invention will be better understood from the following detailed description taken in conjunction with the accompanying drawings wherein.

Figure 1:
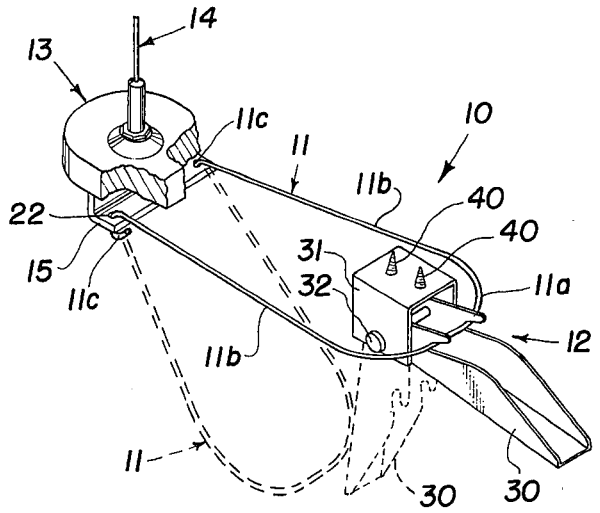
FIG. 1 is a view in perspective, partially broken away, of a security latch device connected with a radio antenna base and showing in broken lines moved release positions of the clamping loop and the tension lever of the latch device.

Referring to the drawings, a quick release security latch device 10 incorporating the features of the invention includes a clamping loop 11 and a tension lever assembly 12. The clamping loop 11 is connectible to the base 13 of an antenna 14. The tension lever is movable between locking and release positions for engagement and disengagement with the clamping loop to quickly selectively lock and release the radio antenna base with supporting structure such as a vehicle trunk lid.

Figure 2:
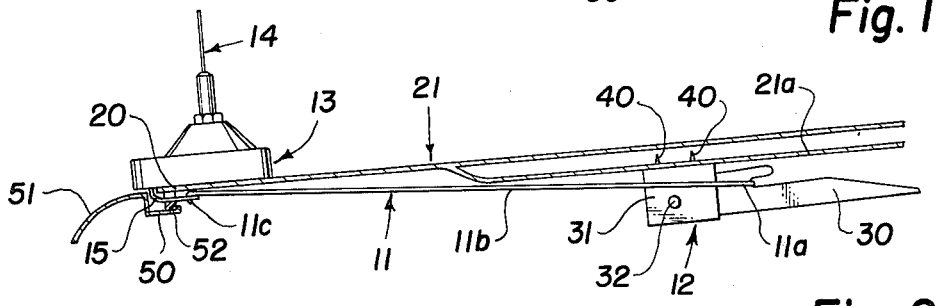
FIG. 2 is an enlarged side view in elevation of the security latch device of FIG. 1 showing the latch device connected with and releasably holding a radio antenna base on a trunk lid lip of a vehicle.
Figure 3:
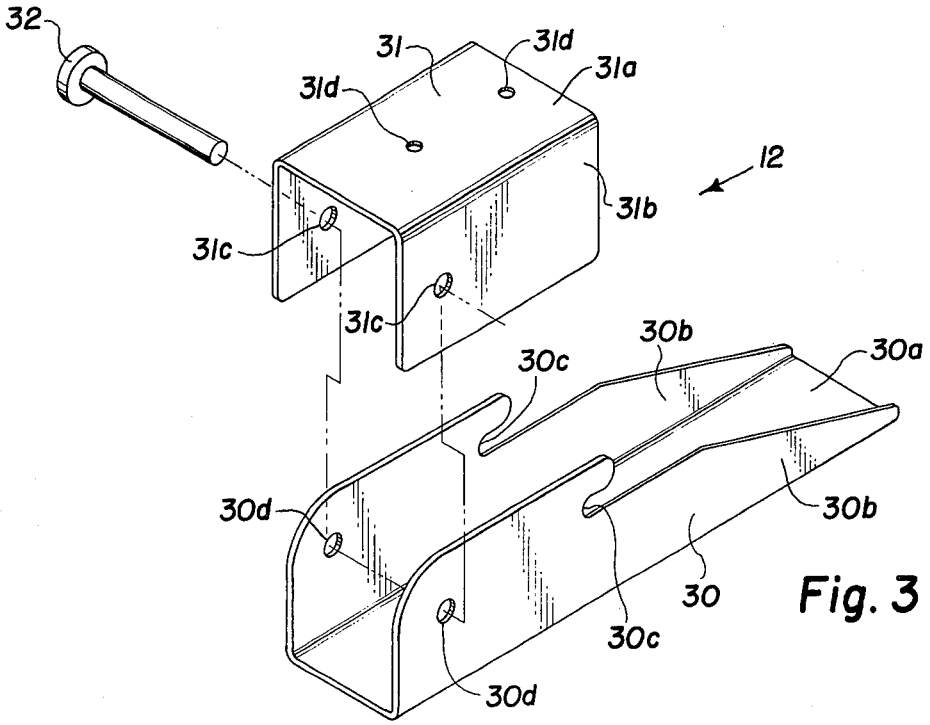
FIG. 3 is an enlarged exploded view in perspective of the tension lever and the lever mounting bracket of the security latch device of the invention.

The clamping loop 11 is a U-shaped one-piece, integral flexible member having a bright portion **11*a*, straight side portions 11*b*, and free end hook portions 11*c*. The radio antenna base 13 and antenna 14 are suitable standard components which may be purchased from any supply house selling citizen's band radios and the like. The antenna base 13 is provided with a lip mounting flange 15 which also is a standard component supplied with many such antenna bases. The mounting flange is designed to fit over an edge or lip of supporting structure such as the lip 20 of an automobile trunk lid lip edge as shown in FIG. 2. The mounting flange is provided with spaced mounting holes 22 which normally are used for mounting screws, not shown, which are installed through the mounting flange into the bottom face of the trunk lid lip in a normal fixed installation. With the present security latch device, the clamping loop end hooks 11*c* fit through the holes 22 of the antenna base mounting flange 15**.

The tension lever assembly 12 includes a tension lever 30, a mounting bracket 31, and a pivot pin 32. The tension lever 30 is a channel shaped member having a bottom portion **30*a* and sides 30*b*. The sides are provided with corresponding locking grooves 30*c* for engagement with the bight portion 11*a* of the clamping loop. The sides are also provided with corresponding holes 30*d* to receive the lever pivot pin 32. The mounting bracket 31 also is a channel shaped member having a top central portion 31*a* and side portions 31*b* which are provided with corresponding holes 31*c* for the pivot pin 32. The central portion 31*a* has holes 31*d* for mounting screws 40, FIG. 1, used to secure the bracket to the inside face of the trunk lid 21. As evident in FIGS. 1 and 2, the tension lever 30 is pivotally secured within the mounting bracket 31 by the pivot pin 32**.

In the normal preferred usage of the security latch device of the invention, the radio antenna base 13 is mounted on the lip 20 of the vehicle trunk lid 21. Depending upon the particular design of the trunk and trunk lid of the vehicle, the antenna base may be mounted either along one of the side edge lips of the trunk lid or along the forward edge. As previously stated, the normal mounting of the antenna base 13 includes securing the base by means of the mounting flange 15 along the trunk lid lip edge and holding the base in place by means of screws such as the screws 40 threaded through the holes 22 into the bottom face of the trunk lid lip edge 20. In accordance with the present invention, however, such a fixed mounting arrangement is replaced by the quick release security latch device of the present invention. The tension lever assembly 12 is mounted on the inside face of the trunk lid 21 as indicated in FIG. 2. The assembly is secured in place within the trunk lid to the inside face of the trunk lid by means of the screws 40 which are threaded from the inside of the mounting bracket 31 through the holes 31*d* into internal trunk lid structure such as the reinforcing member 21*a* which is a structural part of the trunk lid 21. In securing the mounting bracket, the tension lever 30 may be removed from the bracket by disengagement of the pivot pin 32 to provide easier access for manipulation of the screws 40. Alternatively, however, by use of a sufficiently long screw driver and with the channel shaped tension lever 30 pivoted downwardly to the broken line position of FIG. 1, the screws 40 may be engaged without taking the tension lever assembly apart. The location of the tension lever assembly on the inside trunk lid face is determined by where the antenna base 13 is to be located along the trunk lid edge 20. To determine the proper location of the tension lever assembly, the antenna base 13 is held manually on the trunk lid edge 20 and the security latch device is connected with the flange 15 in the general relationship shown in FIGS. 1 and 2. The tension lever assembly 12 is positioned as shown in the locking condition of FIGS. 1 and 2, placing the clamping loop 11 under a sufficient stress to tightly hold the antenna base on the trunk lid lip edge. By manually holding the antenna base and security latch device in such operating position, the trunk lid inner face is marked to properly locate the tension lever assembly mounting bracket 30. The tension lever assembly is then released from the clamping loop and secured by means of the screws 40 to the inside face of the trunk lid as shown.

With the tension lever assembly 12 securely mounted by means of the screws 40 within the trunk lid, the radio antenna base may be quickly installed and released as desired. The tension lever assembly 12 remains permanently secured within the trunk lid as illustrated. In order to secure the radio antenna base on the trunk lid lip, the first step is the connection of the clamping loop 11 with the mounting flange 15 of the aerial base. The hooks 11*c* of the clamping loop are engaged in the pair of holes 22 in the manner illustrated in FIGS. 1 and 2 so that the hook ends are disposed below the mounting flange when the hooks are fully engaged with the flange through the holes 22. The antenna base 13 is then placed on the outside face of the trunk lid 21 at the lip edge 20 with the mounting flange 15 extending around and under the lip edge as seen in FIG. 2. The tension lever 30 hangs loosely at the broken line position of FIG. 1 and may be pivoted farther clockwise than shown in order for the loop to be raised over the tension lever 30. The loosely hanging clamping loop is then lifted counter-clockwise as viewed in FIG. 1 upwardly over the tension lever until the loop bight portion 11*a* enters the locking recesses 30*c* of the tension lever. The tension lever is then pivoted counter-clockwise from the broken line position of FIG. 1 upwardly to the solid line locking position shown in FIGS. 1 and 2. As the tension lever is rotated to the locking position, the clamping loop is placed under tension and stretched to pull the antenna base 13 toward the clamping lever assembly holding the base tightly against the trunk lid lip edge 20. It will be evident from FIG. 2 that when the clamping lever 30 is pivoted to the locking position the clamping loop bight 11*a* passes above the pivot pin 32 which is an over-center position above which the tension in the clamping loop biases the tension lever 30 in a counter-clockwise direction to an end locking position at which the lever is restrained from further rotation by the inside of the trunk lid. At this over-center position held by the clamping loop, the tension lever remains locked until manually released. FIG. 2 illustrates the relationship of the various vehicle trunk parts and the radio antenna base when the antenna is releasably held by the security latch device 10. The tension loop 11 holds the lip mounting flange 15 and the base 13 tightly against the trunk lid lip 20. The flange 15 fits between the bottom face of the lip 20 and a flange 50 on the vehicle body structure position 51 forming the body framing around the trunk lid. The mounting flange 15 is tightly squeezed or clamped between the trunk lid lip 20 and a gasket 52 secured around the body flange 50 for sealing with the trunk lid to make the trunk of the vehicle weather tight. The gasket 52 is sufficiently soft to effectively go around and form a seal with the lip mounting flange 15. The security latch device holds the antenna base sufficiently tight that the antenna will remain in place during normal operating of the vehicle.

The principal advantage of the security latch device 10 is that it makes it possible to remove the radio antenna base 13 along with the antenna 14 within a matter of seconds. When the vehicle is to be left by the operator, the trunk lid is opened and the tension lever 30 is manually rotated in a clockwise direction from the locking position of the solid line representation of FIG. 1 and FIG. 2 to the broken line position illustrated in FIG. 1. At this latter position of the tension lever, the clamping loop 11 drops free downwardly also in a clockwise direction releasing the clamping loop from the tension lever. The radio antenna base is then removed from the trunk lid lip and placed in the trunk of the vehicle. The clamping loop 11 is left connected with the base lip mounting flange 15. Inasmuch as the electrical connection, not shown, extending to the radio antenna runs through the trunk space beneath the trunk lid to the antenna base, there is no need to disconnect the electrical lead when placing the antenna and base in the trunk. With the antenna so removed from the trunk lid and stored in the trunk, the trunk lid is then closed thereby eliminating all external evidence on the vehicle of the existence of a citizen's band radio system within the vehicle. When the operator returns to the vehicle and desires to remount the antenna, it is simply and quickly replaced on the trunk lid lip 20 at the position shown in FIG. 2. The clamping loop 11 is reengaged in the locking recesses 30*c* of the tension lever 30 and the lever is rotated back in a counter-clockwise direction to the locking position shown in FIG. 2. The remounting of the antenna and antenna base on the trunk lid is accomplished within a matter of a very few seconds.

It will be seen that a new and improved quick release security latch device for quickly mounting and removing a citizen's band radio antenna on a vehicle has been described and illustrated. The security latch device permits the complete removal and storage of the radio antenna and base within the trunk of the vehicle thereby removing all outward evidence of the existence of a citizen's band radio system in the vehicle. The security latch device fits closely along the inside face of the trunk lid thereby not requiring any significant space in the trunk or interferring in any way with the normal storage function of the trunk. The security latch device does not interfere with the electrical connection of the radio antenna base and does not require disconnection of the electrical lead when mounting and removing the antenna base on the trunk lid lip.

What is claimed is:

1. A security latch device for quickly releasably mounting and removing a radio antenna base upon supporting structure of a vehicle comprising: a clamping loop connectible with said radio antenna and base and movable between a tensioned locking condition and a relaxed release condition; and a tension lever assembly securable with said supporting structure of said vehicle including a mounting bracket formed by a channel shaped member having a central portion adapted to be secured with said vehicle supporting structure and a tension lever formed of a channel shaped member having locking recess means for engagement by said clamping loop and pivotally secured within said mounting bracket for movement between locking and release positions for releasably engaging said clamping loop for imposing a locking tension on said clamping loop to hold said antenna base on said supporting structure of said vehicle.

2. A security latch device in accordance with claim 1 wherein said clamping loop comprises a one-piece wire member formed in a U-shape having side portions each provided with an end hook for engaging a lip mounting flange on said radio antenna base and said loop being provided with a bight portion of semi-circular configuration adapted to engage said locking recess means on said tention lever.

* * * * *

UNITED STATES PATENT AND TRADEMARK OFFICE

CERTIFICATE OF CORRECTION

PATENT NO. : 4,065,092

DATED : December 27, 1977

INVENTOR(S) : Maurice H. Spinks, Sr. and Yvon E. Juge

It is certified that error appears in the above-identified patent and that said Letters Patent are hereby corrected as shown below:

Column 2, line 16 delete "bright" and insert --bight--.

Signed and Sealed this

Second Day of May 1978

[SEAL]

Attest:

RUTH C. MASON
Attesting Officer

LUTRELLE F. PARKER
Acting Commissioner of Patents and Trademarks